US007195121B2

(12) United States Patent
Anibas

(10) Patent No.: US 7,195,121 B2
(45) Date of Patent: Mar. 27, 2007

(54) SIFTING DEVICE

(75) Inventor: Franz Anibas, Gleisdorf (AT)

(73) Assignee: Binder + Co. Aktiengesellschaft, Gleisdorf (AT)

( * ) Notice: Subject to any disclaimer, the term of this patent is extended or adjusted under 35 U.S.C. 154(b) by 39 days.

(21) Appl. No.: 10/497,331

(22) PCT Filed: Oct. 30, 2002

(86) PCT No.: PCT/AT02/00303

§ 371 (c)(1),
(2), (4) Date: Jun. 1, 2004

(87) PCT Pub. No.: WO03/045587

PCT Pub. Date: Jun. 5, 2003

(65) Prior Publication Data

US 2005/0077214 A1 Apr. 14, 2005

(30) Foreign Application Priority Data

Nov. 29, 2001 (AT) ..... GB M924/2001

(51) Int. Cl.
*B07B 1/28* (2006.01)
*B07B 1/42* (2006.01)

(52) U.S. Cl. ..... 209/344; 209/366

(58) Field of Classification Search ..... 209/312, 209/326, 329, 344, 366, 366.5
See application file for complete search history.

(56) References Cited

U.S. PATENT DOCUMENTS 1,693,940 A * 12/1928 Davis ..... 209/326
3,378,142 A * 4/1968 Wehner ..... 209/325
3,647,068 A * 3/1972 Wehner ..... 209/310
4,033,865 A 7/1977 Derrick, Jr.
4,581,132 A * 4/1986 Fritz et al. ..... 209/310
6,508,364 B2 * 1/2003 Kreft et al. ..... 209/309

FOREIGN PATENT DOCUMENTS

| | | | |
|---|---|---|---|
| DE | 2 243 804 | | 3/1974 |
| DE | 27 20 173 | | 11/1978 |
| DE | 3411719 | A1 * | 10/1984 |
| EP | 0 096 270 | | 12/1983 |
| EP | 0 125 794 | | 11/1984 |
| EP | 0 197 191 | | 10/1986 |
| EP | 1 142 651 | | 10/2001 |
| WO | WO 92/00148 | * | 1/1992 |

* cited by examiner

*Primary Examiner*—Joseph C. Rodriguez
(74) *Attorney, Agent, or Firm*—Collard & Roe, P.C.

(57) ABSTRACT

A sifting device including a sieve box (1), which is caused to oscillate using a drive (4), as a fundamental oscillation system having essentially horizontal first transverse carriers (1.3) and a supplementary oscillation system (2), attached to the sieve box (1), having essentially horizontal second transverse carriers (2.3), positioned essentially parallel to the first transverse carriers, which are each positioned between two first transverse carriers (1.3) and are connected thereto by stretchable sieve liner strips (3), with, for two sequential transverse carriers, the transverse carrier closer to the feeding side (A) being higher than the subsequent transverse carrier, which is closer to the discharge side (B), with the sifting device having at least two sections, in which the height difference between the centers of gravity of two sequential transverse carriers (1.3, 2.3) is greater in the particular feeding-side section than in the discharge-side section.

15 Claims, 5 Drawing Sheets

SIFTING DEVICE

CROSS REFERENCE TO RELATED APPLICATIONS

Applicants claim priority under 35 U.S.C. §119 of Austrian Application No. GM 924/2001 filed on Nov. 29, 2001. Applicants also claim priority under 35 U.S.C. §365 of PCT/AT02/00303 filed on Oct. 30, 2002. The international application under PCT article 21(2) was not published in English.

BACKGROUND OF THE INVENTION

The present invention relates to a sifting device.

In known sifting devices of this type, sieve mats are used, which are alternately tensioned and relaxed in sections over the sieve surface. This is performed mechanically, for example, two movably implemented oscillation systems, such as sieve boxes, being set in oscillation in relation to one another by an eccentric drive using transverse carriers. The plastic sieve liner strips are connected in this case on one end to the transverse carriers of the first sieve box and, on the other end, to the transverse carriers of the second sieve box. Through the opposing oscillations of the two sieve boxes in relation to one another, and therefore of the particular transverse carriers, the plastic sieve liner strips are alternately tensioned and relaxed. In this way, the product to be sifted is separated into the individual fractions. Through the continuous tensioning and releasing, the sifting covers clean themselves again and again and good separation is possible even with sifting product which is difficult to sift.

However, since the sifting product is not subjected to any acceleration in the conveyance direction of the sifting machine through the oscillation, these sifting machines are also placed at a relatively large slant, so that the sifting product may be conveyed by gravity.

Other known sifting machines include a sieve box having transverse carriers to which an oscillating frame having further transverse carriers is elastically coupled. In these sifting machines, the individual sieve liner strips are connected on one end to the transverse carriers of the sieve box and on the other end to the transverse carriers of the oscillating frame. The sieve box is typically caused to oscillate by being excited by the force of an unbalanced drive and may be referred to as a fundamental oscillation system. Through the oscillation of the sieve box, the oscillating frame elastically coupled to this sieve box is caused to oscillate with corresponding tuning of its oscillation system (mass-spring), and thus represents a supplementary oscillation system. Through the oscillation of the sieve box, the product to be sifted is also subjected to acceleration in the conveyance direction of the sifting machine, so that the product is also conveyed solely by the machine. Slanted placement of the sifting machine is therefore not absolutely necessary, and/or only a significantly lesser slant is necessary.

Through the alternating tensioning and releasing of the sieve mats, which are installed in such sifting devices over the sifting length, these mats clean themselves again and again from jammed grain and caking which is caused by fine, damp sifting product.

Banana sieves represent another embodiment. This refers to sifting devices in which the sieve surface is divided into individual sieve surface sections over the sifting length, each of these sieve surface sections having a different slant within the sifting machine. Such constructions are preferably selected if larger feed quantities are to be separated according to grain size and the cutpoint is relatively close to the largest grain of the feed product. The advantage of such sifting machines is that it is possible to keep the dumping height of the sifting product essentially the same over the entire length of the sifting machine through the. differing slants and thus the different conveyance speeds of the product to be sifted, although there is less and less material to be conveyed and sifted on the sifting plane due to the sifting and the passage of the fine fraction through the screen fabric. Uniform dumping height of the sifting product is of great advantage for effective sifting, since otherwise the particles close to the cutpoint only jump on the sifting plane toward the end of the sifting machine and do not have the possibility of making their way through a mesh of the screen fabric.

Sifting machines of this kind are known from, e.g., EP 0 197 191, EP 1 142 651 and WO 92/00148.

SUMMARY OF THE INVENTION

The object of the present invention is to combine the advantages of these two sifting devices. This is done in that, in a way known per se, in a sifting machine which is caused to oscillate by an unbalanced drive, for example, a supplementary oscillation system is installed which is excited by the oscillation of the sifting machine, and, in this way, sieve mats, which are connected on one end to the sifting machine and on the other end to the second oscillation system, are alternately tensioned and relaxed. In order to now additionally achieve the the effect of the banan sieve, the second oscillation system, which is excited by the oscillation of the sifting machine, is implemented using a drive coupled to the sieve box; a fundamental oscillation system having a plurality of substantially horizontal first transverse carriers coupled to the sieve box; a supplementary oscillation system coupled to the sieve box. In this case the system can comprise at least two curved receiving parts positioned essentially parallel to a set of faces on the sieve box; a plurality of substantially horizontal second transverse carriers which are coupled to each other in their end regions via at least two curved receiving parts.

The device can include a plurality of stretchable sieve liner strips for coupling the plurality of substantially horizontal second transverse carriers together. The at least two curved receiving parts can have distributed fixations for coupling together the plurality of substantially horizontal second transverse carriers. This device can include a pendulum axle, a plurality of pendulum arms coupled to the pendulum axle, wherein the pendulum arms are movably coupled to the sieve box and also coupled to the at least two curved receiving parts.

This device can include a transverse carrier that is closer to a feeding side which is higher than a subsequent transverse carrier which is closer to a discharge side. In addition, the sifting device can be in the form of at least two sections, wherein a height difference between the centers of gravity of two sequential transverse carriers is greater in a feeding side section than in a discharge side section. In this case, the oscillation system can be pivotally mounted around the pendulum axle via the pendulum arms to form a sieve surface as a curved plane formed by the stretchable sieve liner strips.

The sieve surfaces, which always represents a plane in all known tensioning shaft sifters, is implemented as a curved plane in the new sifting device, particularly as a segment of a cylinder surface. The sieve surface thus has a greater slant on the feeding side than on the discharge side, which, in addition to the know favorable tensioning shaft sieve movement, also provides the advantage of a banana sieve. Through this shape of the sieve surface, it is possible to provide a supplementary oscillation system by installing: spring elements, which may be brought into a type of pendulum oscillation through the oscillation of the sifting machine, through which the tensioning shaft sieve effect is achieved very simply.

This device can also optionally further include elastic elements, wherein the at least two receiving parts are mounted on the sieve box via a plurality of elastic elements.

In this case, the elastic elements can also optionally be spring elements. For example, these elastic elements can also be leaf springs. This device can also include hinge rods and spring elements, wherein the receiving parts, are mounted on the sieve box via hinge rods, which are hingedly mounted on the sieve box, and wherein the additional spring elements connect the at least two receiving parts to the sieve box and are positioned on a set of faces of the at least two receiving parts and act essentially in an axial direction of the receiving parts.

This device can also optionally further comprise spacer elements and curved guide elements, wherein the receiving parts are mounted on the sieve box via these spacer elements, which are displaceably mounted on the curved guide elements which are connected to the sieve box.

In addition, the guiding of the distance elements along the guide elements is supported by spring elements, which act between the spacer elements and the sieve box.

Furthermore, in an optional feature, the second transverse carriers are connected to two of the at least two curved receiving parts, which are attached via pendulum arms to the pendulum axle which is mounted in a support device, which is connected in a fixed manner to the sieve box.

This device further comprises spring elements, wherein the pendulum arms are connected to the sieve box via the spring elements.

In one optional feature, the drive can be in the form of an oscillation exciter, which is in the form of an unbalanced drive having a single unbalanced weight.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION

Figure 1:
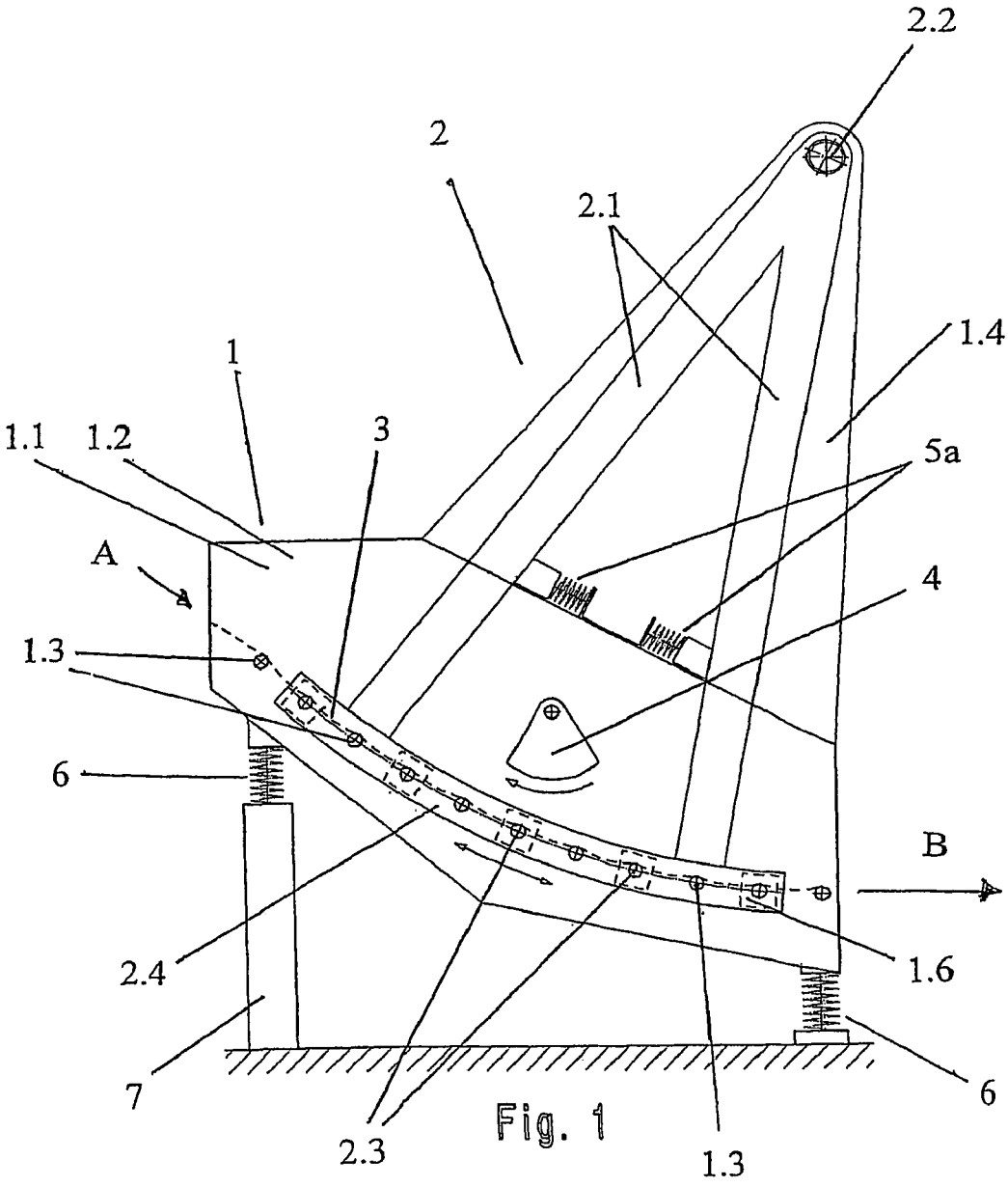
FIG. 1 is a side view of a first embodiment of a supplementary oscillation system to a set of sieve boxes of a fundamental oscillation system.

FIG. 1 schematically shows the construction of such a sifting machine. In this case, the sieve box (1), which includes the sieve faces 1.1, 1.2, between them, and the first transverse carriers 1.3, which connect the sieve faces, is supported via spring elements 6 on brackets. These are caused to oscillate by an unbalanced drive 4. A support device 1.4 is installed on the sieve box, which has a pendulum axle 2.2 (a shaft, for example) for a pendulum-like construction 2 on its upper end. This pendulum-like construction 2 includes the pendulum arms 2.1 and the receiving parts 2.4 for the second transverse carriers 2.3, movable in relation to the sieve box 1, which pass through the sieve boxes through window-like openings 1.6. The transverse carriers 1.3 and 2.3 may be positioned in such a way that they may be understood as surface lines of a cylinder surface whose axis corresponds to the pendulum axle 2.2. The strip-shaped sieve mats 3 are tensioned between the transverse carriers 1.3 and 2.3. Furthermore, spring elements 5*a* may be installed between the sieve box 1 and the pendulum-like construction 2 in order to be able to influence the amplitude of the pendulum oscillation in relation to the fundamental oscillation of the sieve box 1. Through the oscillating movement of the sieve box 1, the pendulum-like construction 2 is also excited to oscillate and, through suitable selection of the dimensions and/or through the additional installation of spring elements, the amplitude of the pendulum-like construction 2 may be influenced. The sifting device is charged at the feeding side A with sifting product, the unsifted product leaving the sifting device at the discharge side, B.

Figure 2:
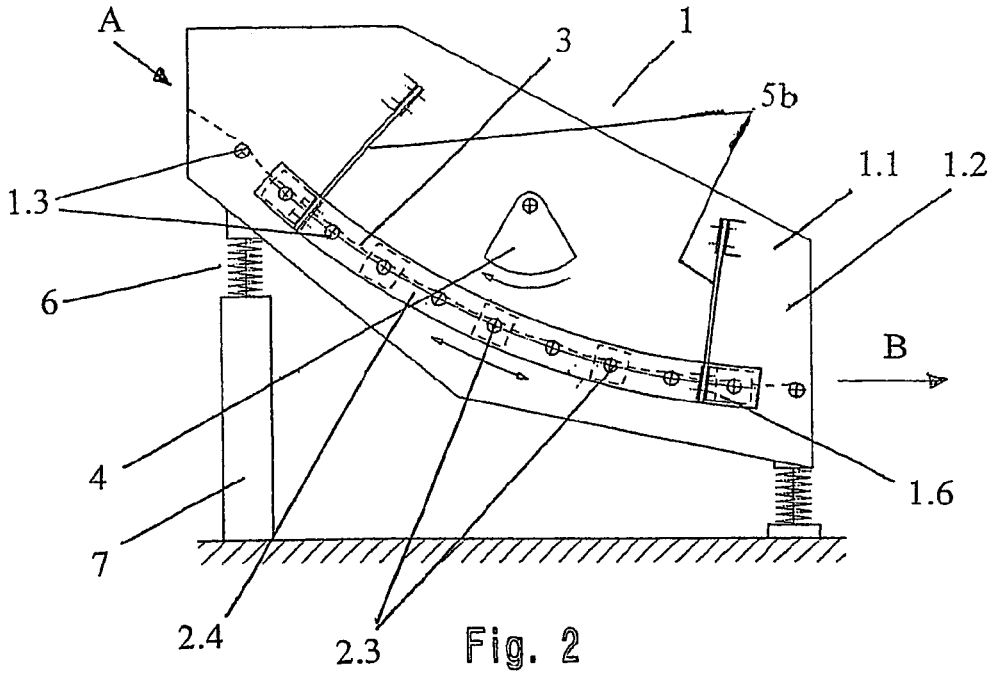
FIG. 2 is a side view of a second embodiment of a supplementary oscillation system to a set of sieve boxes.

FIG. 2 shows another embodiment of the present invention. In this embodiment, the receiving parts 2.4 are guided in approximately a pendulum motion by leaf springs 5*b* which are adjusted in relation to one another and are used simultaneously as spring elements for the supplementary oscillation system excited by the oscillation of the sieve box 1.

Figure 3:
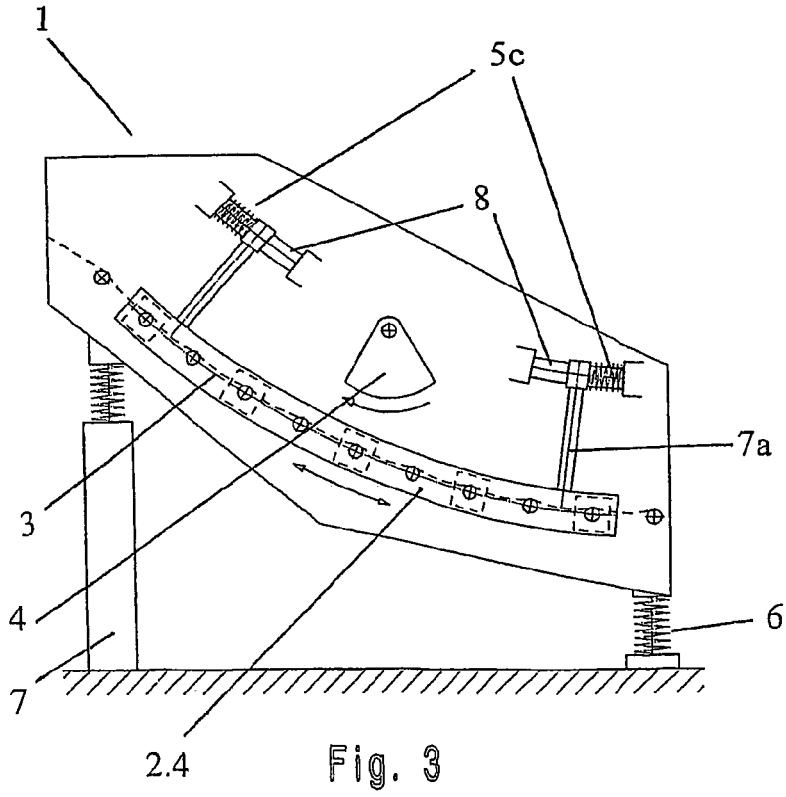
FIG. 3 is a side view of another embodiment of a supplementary oscillation system.
Figure 4:
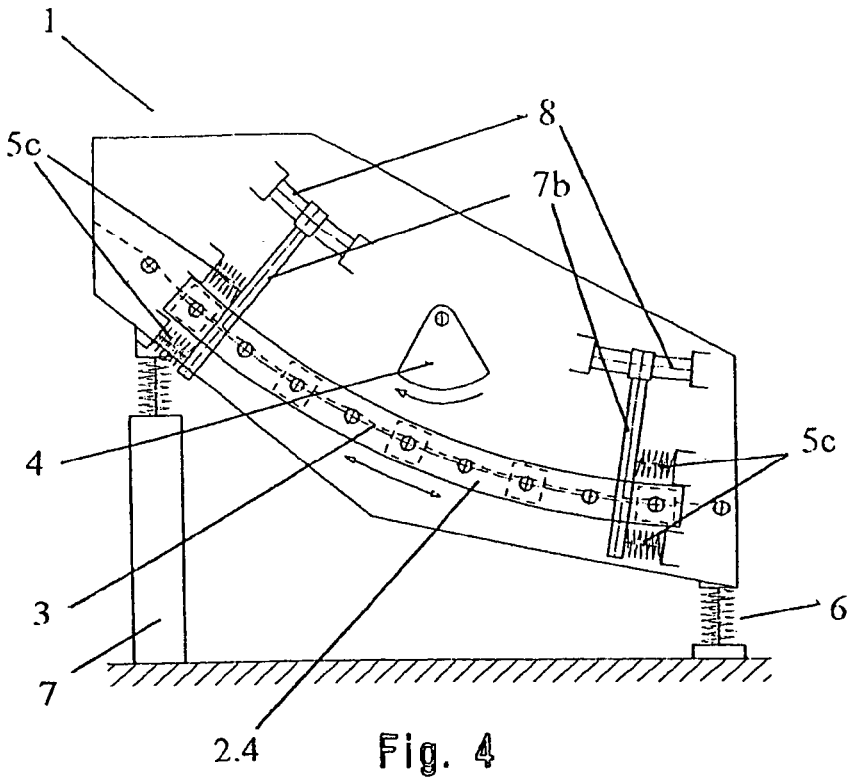
FIG. 4 is a side view of another embodiment of a supplementary oscillation system.

A further embodiment is shown in FIG. 3. In this case, the receiving parts 2.4 are guided in guide elements 8 via spacer elements 7*a*. In order to obtain an oscillation system in this case, it is necessary to install spring elements 5*c* on the guide elements or to position them on or near the receiving parts 2.4, as shown in FIG. 4.

Figure 5:
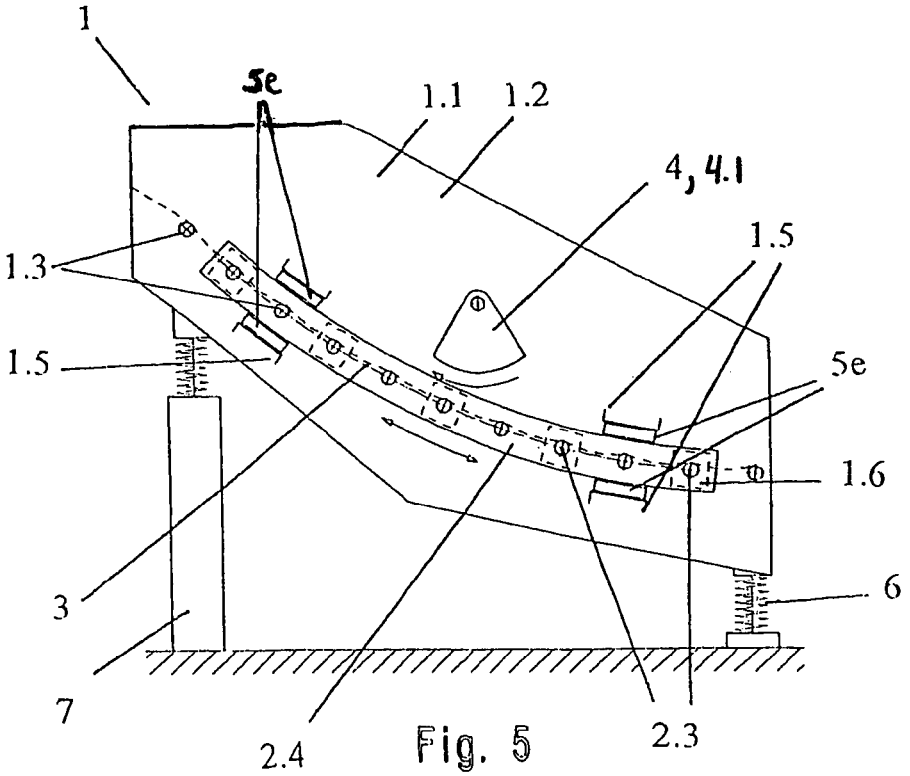
FIG. 5 is a side view of another embodiment of a supplementary oscillation system.

A preferred embodiment of the present invention is shown in FIG. 5. It is essentially constructed in that a sieve box 1, including two sieve faces 1.1, 1.2 and, between them, first transverse carriers 1.3, which connect the sieve faces 1.1, 1.2, is supported via spring elements 6 on brackets, which are caused to oscillate by an oscillation exciter 4, such as an unbalanced exciter. Window-like openings 1.6 are provided on the two side faces 1.1, 1.2 of the sieve box 1, through which the second transverse carriers 2.3 pass. These second transverse carriers 2.3 are attached to receiving parts 2.4. The connecting first transverse carriers 1.3 of the sieve box 1 and the second transverse carriers 2.3 may be positioned, for example, in such a way that they may be understood as surface lines of a cylinder. The receiving parts 2.4 are connected to the sieve box via spring elements 5*e* on spring brackets 1.5, which are positioned fixed on the sieve box 1.

Figure 6:
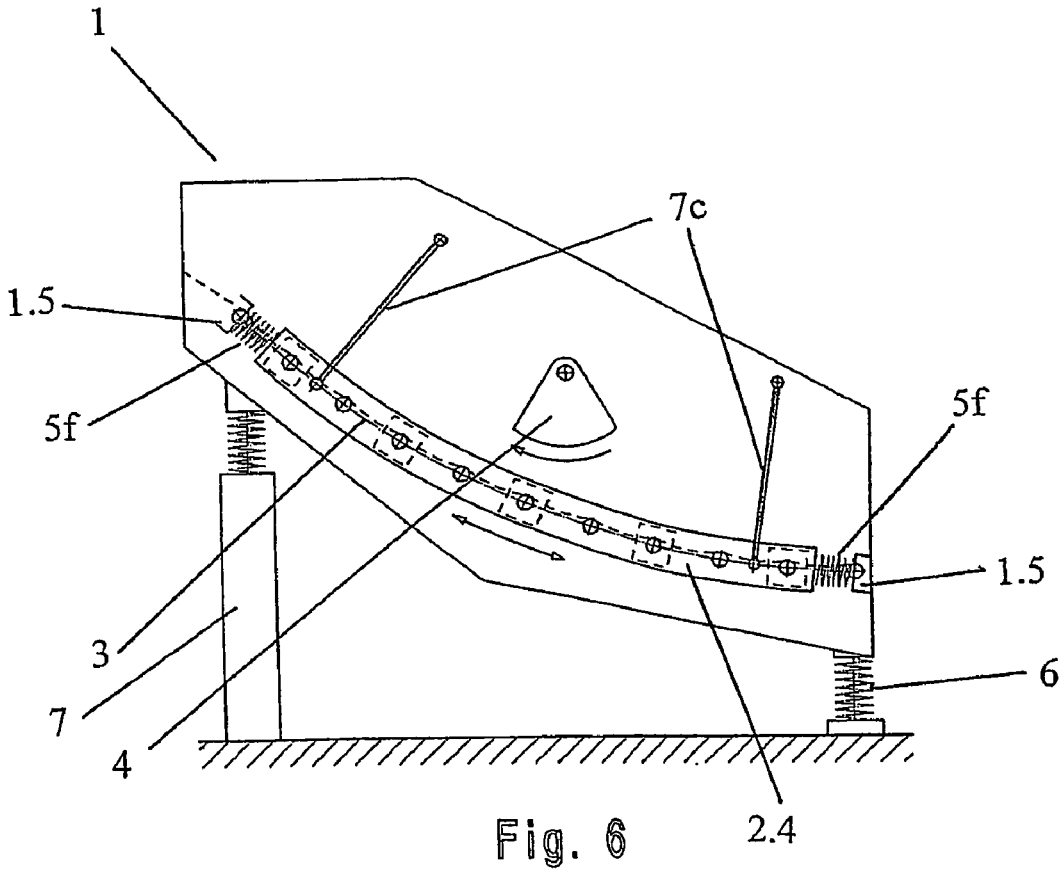
FIG. 6 is a side view of another embodiment of the supplementary oscillation system.

Another embodiment is shown in FIG. 6. In this construction, the receiving parts 2.4 are guided via hinge rods 7*c*, which are mounted in an articulated way on one end on the sieve box 1 and on the other end on the receiving parts 2.4, so that the possibility for oscillation approximately corresponds to a pendulum oscillation. Furthermore, the receiving parts 2.4 are clamped between consoles 1.5, which are connected fixed to the sieve box 1, via spring elements 5*f*.

Figure 7:
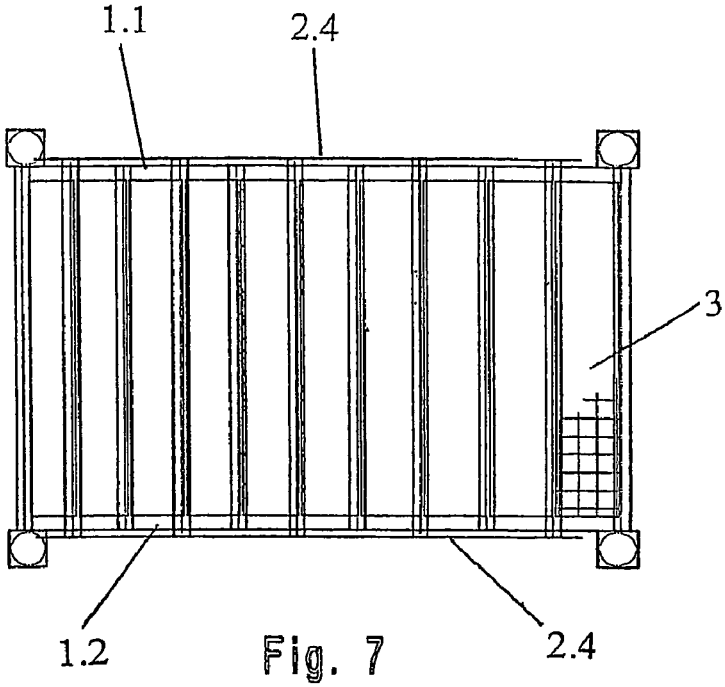
FIG. 7 is a top view of another embodiment of the supplementary oscillation system.
Figure 8:
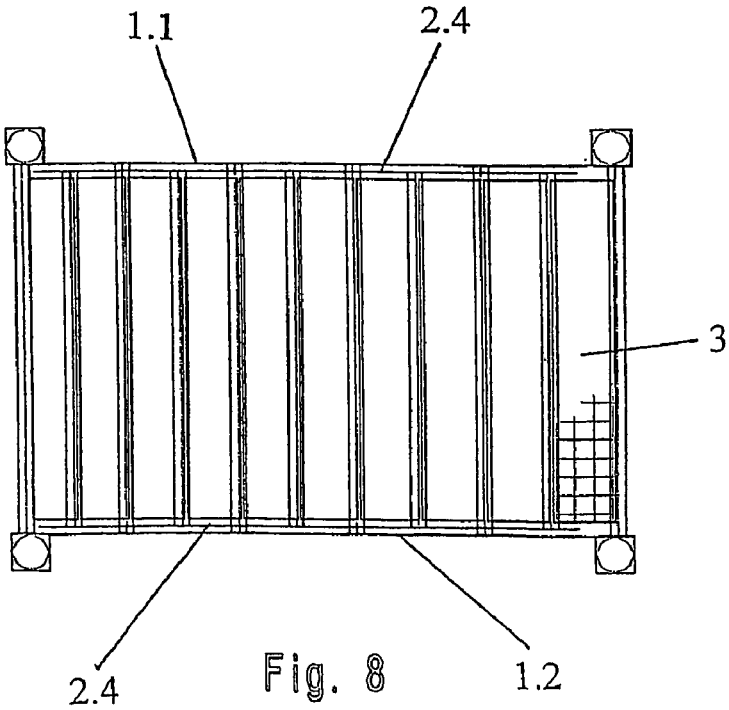
FIG. 8 is a top view of another embodiment of the supplementary oscillation system.

Furthermore, positioning the receiving parts 2.4 either outside (see schematic illustration in FIG. 7) or inside (see FIG. 8) the sieve faces 1.1 and/or 1.2 is provided depending on the separating task. Alternatively FIG. 5, can show however, instead of the unbalanced exciter 4, a linear oscillator 4.1 of known construction having a double unbalanced drive with opposing unbalanced weights is mounted on the sieve box 1 as the oscillation exciter. The sifting device according to the present invention thus combines the advantages of a tensioning shaft sieve with those of a banana sieve and is especially suitable for sifting products which are difficult to sift.

Accordingly, while a few embodiments of the present invention have been shown and described, it is to be understood that many changes and modifications may be made thereunto without departing from the spirit and scope of the invention as defined in the appended claims.

What is claimed is:

1. A sifting device for a sieve box comprising:

a) a drive coupled to the sieve box;

b) a fundamental oscillation system having a plurality of substantially horizontal first transverse carriers coupled to the sieve box;

c) a supplementary oscillation system coupled to the sieve box, the system comprising:

i) at least two curved receiving parts positioned essentially parallel to a set of faces on the sieve box;

ii) a plurality of substantially horizontal second transverse carriers which are coupled to each other in their end regions via said at least two curved receiving parts, and positioned substantially parallel to said plurality of substantially horizontal first transverse carriers and which are each positioned between at least two of said plurality of substantially horizontal first transverse carriers;

iii) a plurality of stretchable sieve liner strips for coupling said plurality of substantially horizontal second transverse carriers together and wherein said at least two curved receiving parts have distributed fixations for coupling together said plurality of substantially horizontal second transverse carriers;

d) a pendulum axle;

e) a plurality of pendulum arms coupled to said pendulum axle, said pendulum arms being movably coupled to the sieve box and also coupled to said at least two curved receiving parts, wherein a transverse carrier that is closer to a feeding side is higher than a subsequent transverse carrier which is closer to a discharge side, and wherein said sifting device is in the form of at least two sections, wherein a height difference between the centers of gravity of two sequential transverse carriers is greater in a feeding side section than in a discharge side section such that said oscillation system is pivotally mounted around said pendulum axle via said pendulum arms to form a sieve surface as a curved plane formed by said stretchable sieve liner strips.

2. The sifting device according to claim 1, further comprising elastic elements, wherein said at least two receiving parts, are mounted on the sieve box via a plurality of elastic elements.

3. The sifting device according to claim 2, wherein said elastic elements are leaf springs.

4. The sifting device according to claim 2, wherein said elastic elements are spring elements.

5. The sifting device according to claim 1, further comprising hinge rods and spring elements, wherein said at least two receiving parts, are mounted on the sieve box via said hinge rods, which are hingedly mounted on the sieve box, and wherein said additional spring elements connect said at least two receiving parts to the sieve box and are positioned on a set of faces of said at least two receiving parts and act essentially in an axial direction of said receiving parts.

6. The sifting device according to claim 5, further comprising spacer elements wherein the guiding of said spacer elements along the guide elements is supported by said spring elements, which act between said spacer elements and the sieve box.

7. The sifting device according to claim 1, further comprising spacer elements and curved guide elements, wherein said at least two receiving parts, are mounted on the sieve box via said spacer elements, which are displaceably mounted on said curved guide elements, which are connected to the sieve box.

8. The sifting device according to claim 1, wherein the said second transverse carriers are connected to two of said at least two curved receiving parts, which are attached via pendulum arms to said pendulum axle, which is mounted in a support device, which is connected fixed to the sieve box.

9. The sifting device according to claim 8, further comprising spring elements, wherein said pendulum arms are connected to the sieve box via said spring elements.

10. The sifting device according to claim 1, wherein said drive is in the form of an oscillation exciter, which is in the form of an unbalanced drive having a single unbalanced weight.

11. The sifting device as in claim 1, wherein said drive is in the form of an oscillation exciter in the form of a double unbalanced drive.

12. The device as in claim 11, wherein said double unbalanced drive includes at least two unbalanced weights.

13. The device as in claim 11 wherein said double unbalanced drive includes at least two unbalanced motors.

14. the device as in claim 11, wherein said double unbalanced drive is in the form of a drive having a magnetic oscillating drive that is mounted on the sieve box and an eccentric drive that is mounted between the sieve box and the supplementary oscillation system.

15. A sifting device for a sieve box consisting of:

a) a drive coupled to the sieve box;

b) a fundamental oscillation system having a plurality of substantially horizontal first transverse carriers coupled to the sieve box;

c) a supplementary oscillation system coupled to the sieve box, the system comprising:

i) at least two curved receiving parts positioned essentially parallel to a set of faces on the sieve box;

ii) a plurality of substantially horizontal second transverse carriers which are coupled to each other in their end regions and positioned substantially parallel to said plurality of substantially horizontal first transverse carriers and which are each positioned between at least two of said plurality of substantially horizontal first transverse carriers;

iii) a plurality of stretchable sieve liner strips for coupling said plurality of substantially horizontal second transverse carriers together and wherein said at least two curved receiving parts have distributed fixations for coupling together said plurality of substantially horizontal second transverse carriers;

d) a pendulum axle;

e) two pendulum arms coupled to said pendulum axle, said pendulum arms being movably coupled to the sieve box and also coupled to said at least two curved receiving parts, wherein a transverse carrier that is closer to a feeding side is higher than a subsequent transverse carrier which is closer to a discharge side, and wherein said sifting device is in the form of at least two sections, wherein a height difference between the centers of gravity of two sequential transverse carriers is greater in a feeding side section than in a discharge side section such that said oscillation system is pivotally mounted around said pendulum axle via said pendulum arms to form a sieve surface as a curved plane formed by said stretchable sieve liner strips.

* * * * *